US011492231B2

(12) United States Patent
Kondo et al.

(10) Patent No.: US 11,492,231 B2
(45) Date of Patent: Nov. 8, 2022

(54) ELEVATOR APPARATUS

(71) Applicant: Mitsubishi Electric Corporation, Chiyoda-ku (JP)

(72) Inventors: Rikio Kondo, Tokyo (JP); Yoshitaka Kariya, Tokyo (JP); Masahiko Hida, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 1021 days.

(21) Appl. No.: 16/094,140

(22) PCT Filed: May 23, 2016

(86) PCT No.: PCT/JP2016/065156
§ 371 (c)(1),
(2) Date: Oct. 16, 2018

(87) PCT Pub. No.: WO2017/203561
PCT Pub. Date: Nov. 30, 2017

(65) Prior Publication Data

US 2019/0135582 A1 May 9, 2019

(51) Int. Cl.
*B66B 5/00* (2006.01)
*B66B 5/02* (2006.01)
(Continued)

(52) U.S. Cl.
CPC ..... *B66B 5/0037* (2013.01); *B66B 1/3476* (2013.01); *B66B 1/3492* (2013.01);
(Continued)

(58) Field of Classification Search
CPC ..... B66B 5/0037; B66B 1/30; B66B 5/04; B66B 5/044; B66B 1/3492; B66B 5/0018;
(Continued)

(56) References Cited

U.S. PATENT DOCUMENTS

2012/0193171 A1 8/2012 Kangas

FOREIGN PATENT DOCUMENTS

CN 1882490 A * 12/2006
CN 104395215 B * 9/2016 ..... B66B 1/32
(Continued)

OTHER PUBLICATIONS

Indian Examination Report dated Jan. 31, 2020, in Patent Application No. 201847041332, 6 pages.
(Continued)

*Primary Examiner* — Marlon T Fletcher
(74) *Attorney, Agent, or Firm* — Oblon, McClelland, Maier & Neustadt, L.L.P.

(57) ABSTRACT

An elevator apparatus includes: a traction machine including a sheave around which a middle portion of a main rope from which a car and counterweight are suspended is wound; a controller configured to control travel of the car; a section specification unit configured to specify a determination target section serving as a travel section, including at least a travel position of the car, satisfying a predetermined determination execution condition; a sheave rotation detector configured to detect a sheave rotation amount; and a determinator configured to determine traction performance of the sheave based on the sheave rotation amount detected during travel of the car in the determination target section. The determination execution condition is to have a load weight and an acceleration of the car that cause direction of an acceleration vector of one of a car side and a counterweight side heavier than the other to match an ascent direction.

12 Claims, 6 Drawing Sheets

(51) Int. Cl.
*B66B 1/34* (2006.01)
*B66B 11/00* (2006.01)

(52) U.S. Cl.
CPC ..... *B66B 5/0025* (2013.01); *B66B 5/02* (2013.01); *B66B 11/008* (2013.01)

(58) Field of Classification Search
CPC ..... B66B 11/08; B66B 11/008; B66B 11/04; B66B 1/3476; B66B 11/043; B66B 15/04; B66B 1/24; B66B 5/0006; B66B 5/12; B66B 11/009
See application file for complete search history.

(56) References Cited

FOREIGN PATENT DOCUMENTS

| | | | | | |
|---|---|---|---|---|---|
| CN | 106255657 | A | * | 12/2016 | ..... B66B 1/3492 |
| CN | 109562910 | A | * | 4/2019 | ..... B66B 5/04 |
| CN | 109573774 | A | * | 4/2019 | ..... B66B 11/08 |
| CN | 110267895 | A | * | 9/2019 | ..... B66B 1/32 |
| CN | 111942995 | A | * | 11/2020 | ..... B66B 5/0018 |
| CN | 112777446 | A | * | 5/2021 | ..... B66B 5/0031 |
| EP | 2 213 606 | A1 | | 8/2010 | |
| JP | 3-8681 | A | | 1/1991 | |
| JP | 6-16362 | A | | 1/1994 | |
| JP | 2007-153547 | A | | 6/2007 | |
| JP | 2021075378 | A | * | 5/2021 | ..... B66B 5/0037 |
| KR | 0186121 | B1 | * | 4/1999 | |
| KR | 20170020440 | A | * | 2/2017 | |
| WO | WO-0055085 | A1 | * | 9/2000 | |
| WO | WO-2005115902 | A1 | * | 12/2005 | ..... B66B 5/0037 |
| WO | WO-2006120737 | A1 | * | 11/2006 | |
| WO | WO-2009098772 | A1 | * | 8/2009 | ..... B66B 1/3492 |
| WO | WO 2011/042612 | A1 | | 4/2011 | |
| WO | WO-2015166602 | A1 | * | 11/2015 | ..... B66B 1/3492 |
| WO | WO-2016190281 | A1 | * | 12/2016 | ..... B66B 5/0037 |
| WO | WO-2021116527 | A1 | * | 6/2021 | |

OTHER PUBLICATIONS

International Search Report dated Aug. 2, 2016, in PCT/JP2016/065156 filed May 23, 2016.

* cited by examiner

30: TRACTION DIAGNOSIS UNIT
31 SECTION SPECIFICATION UNIT
32: PREVIOUS DATA STORAGE UNIT
33: DETERMINATION UNIT
34. REFERENCE VALUE STORAGE UNIT
35: REFERENCE VALUE CORRECTION UNIT
36: NOTIFICATION UNIT

30: TRACTION DIAGNOSIS UNIT
31 SECTION SPECIFICATION UNIT
32: PREVIOUS DATA STORAGE UNIT
33: DETERMINATION UNIT
36: NOTIFICATION UNIT

FIG. 6

| FLOOR | OPERATION | TYPE | LATEST | PAST1 | PAST2 | | AVG. | DIFF. |
|---|---|---|---|---|---|---|---|---|
| 2F | START DN DIR. | PULSE | 3880 | 3840 | 3827 | | 3849 | 21 |
| | | DATE | 11/10 | 11/9 | 11/7 | | | |
| | STOP UP DIR. | PULSE | 3830 | 3827 | 3827 | | 3828 | |
| | | DATE | 11/10 | 11/10 | 11/6 | | | |
| 3F | START DN DIR. | PULSE | 4120 | 4122 | | | 4121 | 3 |
| | | DATE | 11/10 | 11/8 | | | | |
| | STOP UP DIR. | PULSE | 4120 | 4117 | 4120 | | 4118 | |
| | | DATE | 11/10 | 11/9 | 11/7 | | | |
| 4F | START DN DIR. | PULSE | 4030 | 4030 | 4027 | | 4029 | 0 |
| | | DATE | 11/10 | 11/6 | 11/3 | | | |
| | STOP UP DIR. | PULSE | 4029 | 4015 | 4000 | | 4029 | |
| | | DATE | 11/10 | 6/2 | 1/3 | | | |

ELEVATOR APPARATUS

TECHNICAL FIELD

The invention relates to an elevator apparatus.

BACKGROUND ART

As a conventional elevator apparatus, there is known an elevator apparatus in which, in order to detect an amount of slippage of an elevator main rope, an ascent travel distance value is computed based on an ascent pulse signal from an encoder in the case where an ascent operation of a car from any floor to another floor is performed, a descent travel distance value is computed based on a descent pulse signal from the encoder in the case where a descent operation of the car between the same floors as those of the ascent operation is performed and, thereafter, a difference between the ascent travel distance value and the descent travel distance value is measured as the amount of slippage of the main rope (see, e.g., PTL 1).

CITATION LIST

Patent Literature

[PTL 1] Japanese Patent Application Publication No. 2007-153547

SUMMARY OF INVENTION

Technical Problem

However, particularly in an initial stage when a reduction in the traction performance of a sheave of a traction machine has just started, the amount of slippage of the main rope is minute. Consequently, in the technique disclosed in PTL 1, it is difficult to detect the minute amount of slippage of the main rope in order to detect the reduction in the traction performance as soon as possible in the initial stage of the reduction in the traction performance.

The invention has been made in order to solve the above problem, and makes it possible to obtain an elevator apparatus capable of detecting, even in an initial stage of a reduction in the traction performance of a sheave of a traction machine, a minute amount of slippage of a main rope relative to the sheave in order to detect the reduction in the traction performance as soon as possible.

Solution to Problem

An elevator apparatus according to the present invention includes: a traction machine having a sheave around which a middle portion of a main rope is wound, the main rope having one end from which a car is suspended and the other end from which a counterweight is suspended; a control unit configured to cause the car to travel by controlling an operation of the traction machine; a section specification unit configured to specify a determination target section, the determination target section being a travel section including at least a travel position of the car at which a predetermined determination execution condition is satisfied; a sheave rotation detector configured to detect a rotation amount of the sheave; and a determination unit configured to determine traction performance of the sheave, based on the rotation amount of the sheave detected by the sheave rotation detector during travel of the car in the determination target section, wherein the determination execution condition is satisfied when a load weight and an acceleration of the car that cause a direction of an acceleration vector of one of a car side and a counterweight side that is heavier than the other to match an ascent direction occurs.

Advantageous Effects of Invention

In the elevator apparatus according to the invention, there is obtained an effect that it is possible to detect, even in the initial stage of the reduction in the traction performance of the sheave of the traction machine, the minute amount of slippage of the main rope relative to the sheave in order to detect the reduction in the traction performance immediately.

BRIEF DESCRIPTION OF THE DRAWINGS

FIG. 6 is a view for explaining an example of a traction diagnosis method of the sheave of the elevator apparatus related to Embodiment 2 of the present invention.

DESCRIPTION OF EMBODIMENTS

Figure 1:
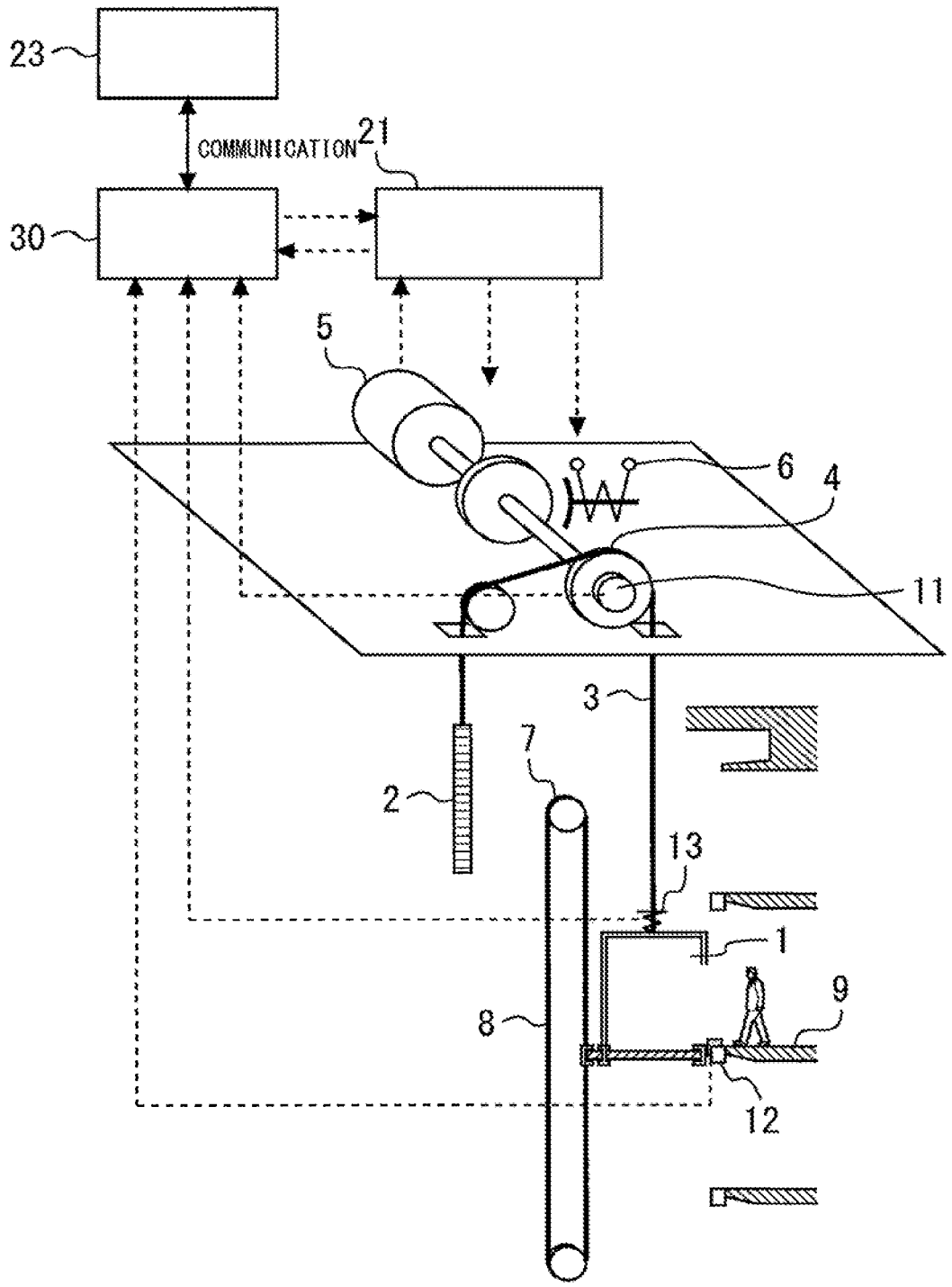
FIG. 1 is a view schematically showing the overall configuration of an elevator apparatus related to Embodiment 1 of the present invention.

Embodiments of the invention will be described with reference to the accompanying drawings. In the drawings, the same or corresponding parts are designated by the same reference numerals, and the repeated description thereof will be appropriately simplified or omitted. Note that the present invention is not limited to the following embodiments, and can be variously modified without departing from the gist of the present invention.

Embodiment 1.

Figure 2:
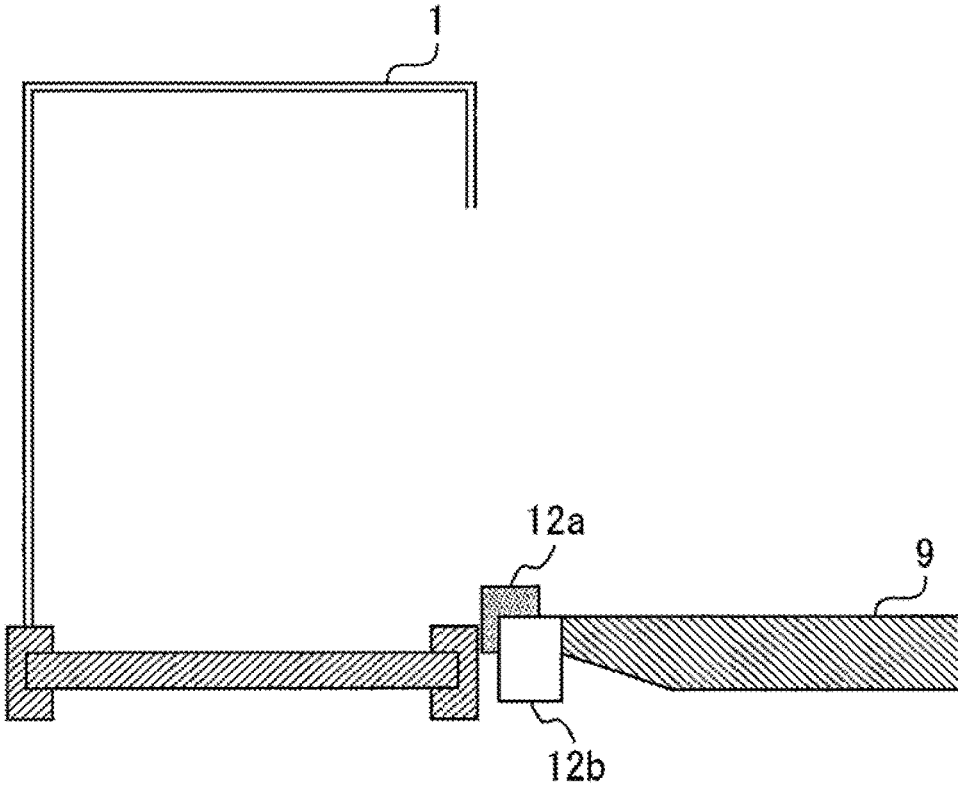
FIG. 2 is a view showing a car position detector provided in the elevator apparatus related to Embodiment 1 of the present invention.
Figure 3:
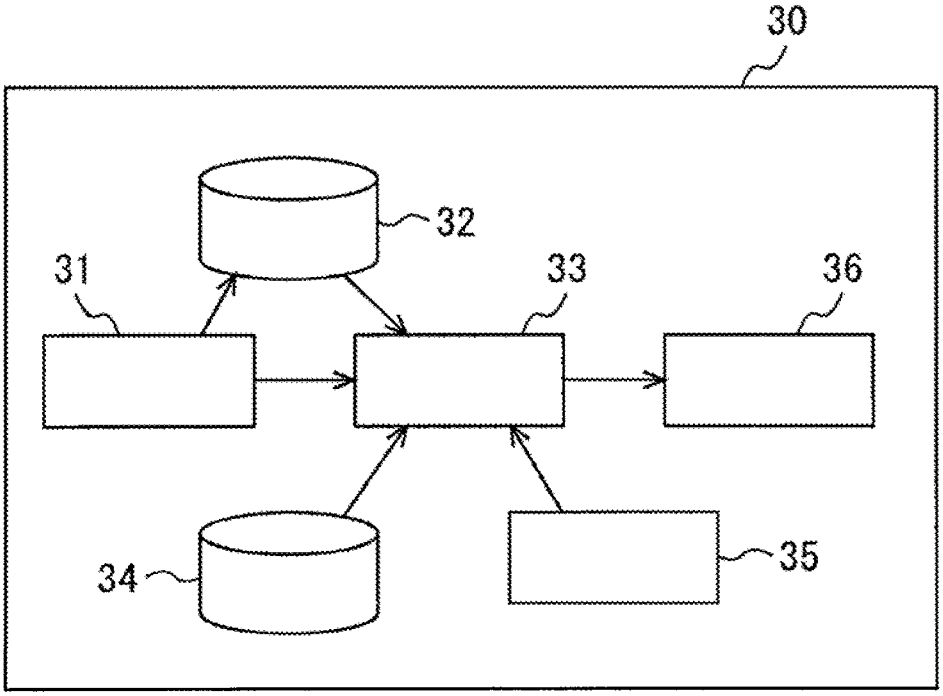
FIG. 3 is a block diagram showing the configuration of a traction determination unit provided in the elevator apparatus related to Embodiment 1 of the present invention.
Figure 4:
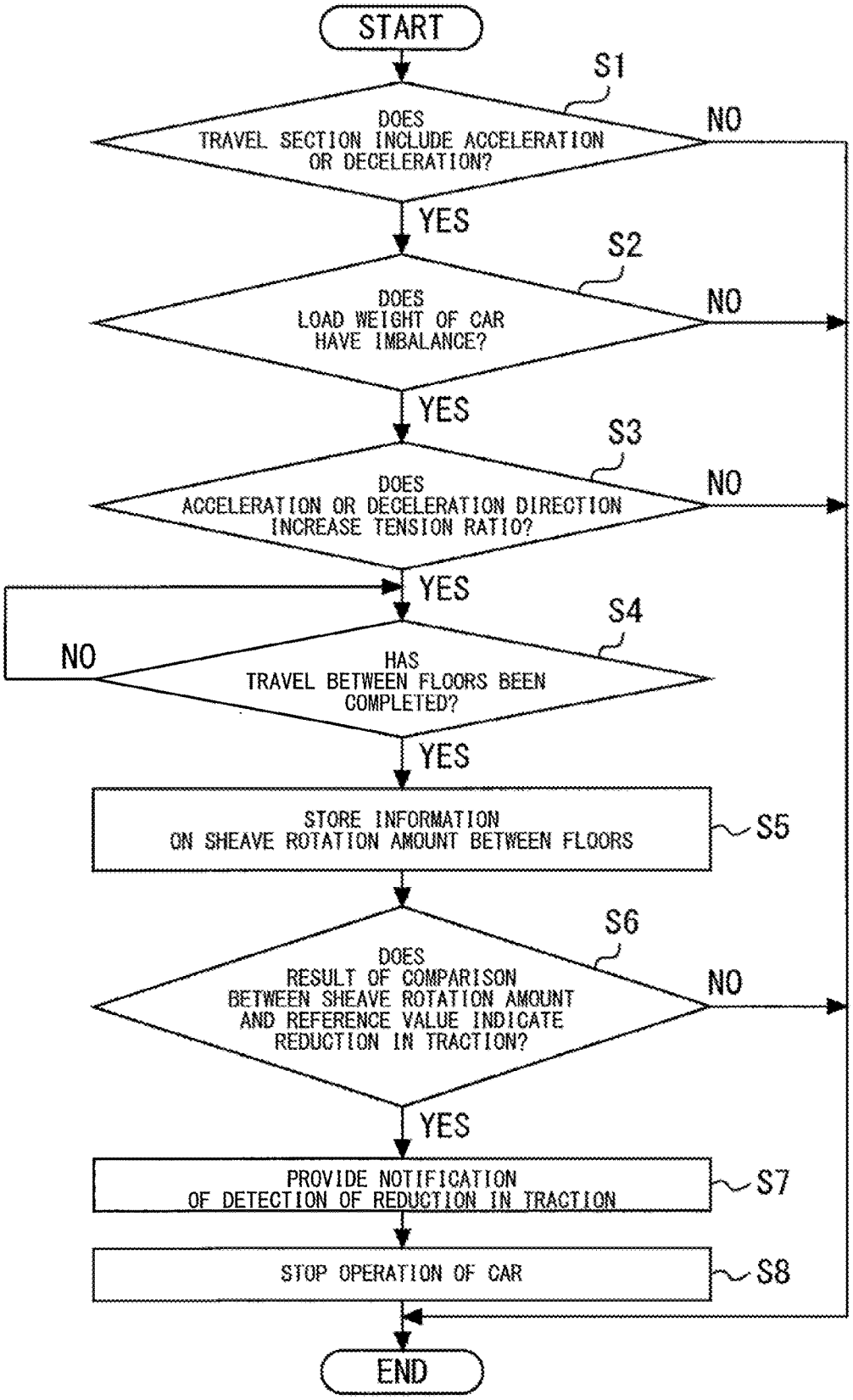
FIG. 4 is a flowchart showing an example of the operation of the elevator apparatus related to Embodiment 1 of the present invention.

FIGS. 1 to 4 relate to Embodiment 1 of the invention. FIG. 1 is a view schematically showing the overall configuration of an elevator apparatus, FIG. 2 is a view showing a car position detector provided in the elevator apparatus, FIG. 3 is a block diagram showing the configuration of a traction determination unit provided in the elevator apparatus, and FIG. 4 is a flowchart showing an example of the operation of the elevator apparatus.

As shown in FIG. 1, a car 1 is installed in a shaft of an elevator. The car 1 ascends and descends in the shaft while being guided by a guide rail that is not shown. One end of a main rope 3 is coupled to the upper end of the car 1. The other end of the main rope 3 is coupled to the upper end of a counterweight 2. The counterweight 2 is installed in the shaft so as to be able to ascend and descend.

The middle portion of the main rope 3 is wound around a sheave 4 of a traction machine 5 installed at the top portion of the shaft. In addition, the middle portion of the main rope 3 is also wound around a deflector sheave provided adjacent to the sheave 4 at the top portion of the shaft. In this manner, the car 1 and the counterweight 2 are suspended like well buckets that are caused to ascend and descend in mutually opposite directions in the shaft by the main rope 3. That is, the elevator to which a diagnosis device of the elevator according to the invention is applied is what is called a traction type elevator.

The traction machine 5 rotationally drives the sheave 4. When the traction machine 5 rotates the sheave 4, the main rope 3 moves by friction between the main rope 3 and the sheave 4. When the main rope 3 moves, the car 1 and the counterweight 2 suspended from the main rope 3 ascend and descend in mutually opposite directions in the shaft.

A brake 6 is provided in the traction machine 5. The brake 6 is provided for braking the rotation of the traction machine 5, i.e., the rotation of the sheave 4. A governor 7 is installed in the shaft of the elevator. The governor 7 includes a governor rope 8. The governor rope 8 is an endless rope that is wound around a governor sheave provided in the vicinity of each of the top portion and the bottom portion of the shaft. One side of the governor rope 8 is connected to the car 1. Consequently, the governor rope 8 circularly moves in response to the travel of the car 1. When the governor rope 8 circularly moves, the governor sheave rotates. The rotation direction and rotation speed of the governor sheave at this point correspond to the travel direction and travel speed of the car 1.

Each floor at which the car 1 can stop is provided with a hall 9. The hall 9 is a place for a user of the elevator to get on and get off the car 1. A sheave rotation detector 11 is attached to the sheave 4 of the traction machine 5. The sheave rotation detector 11 includes, e.g., an encoder. The encoder outputs, e.g., a pulsed signal in accordance with the rotational phase angle of the sheave 4. It is possible to detect the rotation amount of the sheave 4 by counting the number of pulses of the pulsed signal outputted from the encoder.

A car position detector 12 is provided in the elevator apparatus. The car position detector 12 is provided for detecting the position of the car 1 in the shaft. More specifically, the car position detector 12 detects the presence of the car 1 in a door zone of each floor. The door zone is the range of the position of the car 1 that allows the car 1 to arrive at the hall 9 of each floor and allows the door of the elevator to be opened or closed.

As shown in FIG. 2, the car position detector 12 includes a plate detection device 12*a* and a detection plate 12*b*. The plate detection device 12*a* is attached to the car 1. The detection plate 12*b* is attached to the side of the hall 9 in the shaft in correspondence to each floor at which the car 1 can stop. The installation position of the detection plate 12*b* of each floor is adjusted such that the detection plate 12*b* enters the detection area of the plate detection device 12*a* when the position of the car 1 is in the door zone, and the detection plate 12*b* does not enter the detection area of the plate detection device 12*a* when the position of the car 1 is outside the door zone.

Thus, the detection plate 12*b* is installed at each floor. Based on the detection result of the car position detector 12, it is possible to determine not only whether or not the position of the car 1 is in the door zone but also a floor on which the position of the car 1 is in the door zone, or floors between which the position of the car 1 is located. Consequently, the car position detector 12 constitutes a car position detection unit configured to detect the travel position of the car 1.

The description will be continued with reference to FIG. 1 again. A weighing device 13 is attached to the car 1. The weighing device 13 detects the weight of a load in the car 1. That is, the weighing device 13 constitutes a car weight detection unit configured to detect the load weight of the car 1.

The entire operational actions of the thus configured elevator apparatus are controlled by an elevator control unit 21. For example, the elevator control unit 21 controls the travel of the car 1 based on the detection results of the sheave rotation detector 11, the car position detector 12, and the weighing device 13. The travel control of the car 1 is performed by controlling the operation of each of the traction machine 5 and the brake 6 by the elevator control unit 21. That is, the operation of the traction machine 5 is controlled by the elevator control unit 21. Consequently, the elevator control unit 21 constitutes a control unit configured to cause the car 1 to travel by controlling the operation of the traction machine 5.

The status of the elevator apparatus is monitored in an information center 23 that is located remotely from a building in which the elevator apparatus is installed. The building in which the elevator apparatus is installed and the information center 23 are connected so as to be able to communicate with each other via a communication network such as, e.g., the Internet such that transmission and reception of various pieces of information can be performed.

The elevator apparatus according to Embodiment 1 of the invention includes a traction diagnosis unit 30. The traction diagnosis unit 30 checks the traction performance of the sheave 4. In the traction type elevator, the rotation of the sheave 4 is converted to the movement of the main rope 3 by friction exerted between the sheave 4 and the main rope 3, and the car 1 is thereby caused to ascend and descend. When the friction exerted between the sheave 4 and the main rope 3 becomes insufficient, "slippage" occurs between the sheave 4 and the main rope 3. A state in which the "slippage" is present between the sheave 4 and the main rope 3 is a state in which the traction performance is inadequate. To cope with this, the traction diagnosis unit 30 checks the traction performance of the sheave 4 by determining whether or not the "slippage" is present between the sheave 4 and the main rope 3.

The configuration of the traction diagnosis unit 30 will be described with reference to FIG. 3. As shown in FIG. 3, the traction diagnosis unit 30 includes a section specification unit 31, a previous data storage unit 32, a determination unit 33, a reference value storage unit 34, and a reference value correction unit 35.

The section specification unit 31 specifies, each time the car 1 travels, a determination target section serving as a target of determination of the traction performance of the sheave 4 by the determination unit 33. The determination target section is a travel section that includes at least the travel position of the car 1 that satisfies a predetermined determination execution condition.

The determination execution condition is to have the load weight and the acceleration of the car 1 that cause the direction of an acceleration vector of one of the car 1 side and the counterweight 2 side that is heavier than the other to match an ascent direction. The determination execution condition will be described in detail by using specific cases. First, a description will be given of "one of the side of the car 1 and the side of the counterweight 2 that is heavier than the other" in the determination execution condition. Herein, the weight of the counterweight 2 is set to be equal to the weight of the side of the car 1 in the case where the load weight of the car 1 is 50% of the maximum load weight. Consequently, "one of the side of the car 1 and the side of the counterweight 2 that is heavier than the other" is determined by the following (1) and (2).

(1) When the load weight of the car 1 is more than 50% of the maximum load weight, the side of the car 1 is heavier than the side of the counterweight 2.

(2) When the load weight of the car 1 is less than 50% of the maximum load weight, the side of the counterweight 2 is heavier than the side of the car 1.

Next, a description will be given of "the direction of the acceleration vector matches the ascent direction" in the determination execution condition. First, in order to cause the direction of the acceleration vector to match the ascent direction, it is necessary that the acceleration is not 0. The case where the acceleration of each of the car 1 and the counterweight 2 is not 0 corresponds to the case where the car 1 accelerates or decelerates. The acceleration and deceleration of the car 1 are performed in each of the case where the car 1 ascends and the case where the car 1 descends. Consequently, the direction of the acceleration vector of each of the car 1 and the counterweight 2 in each of combinations of the travel directions (ascent and descent) of the car 1, the acceleration, and the deceleration includes the following (A) to (D).

(A) During acceleration in the case where the car 1 ascends, the direction of the acceleration vector of the car 1 is the ascent direction, and the direction of the acceleration vector of the counterweight 2 is the descent direction.

(B) During deceleration in the case where the car 1 ascends, the direction of the acceleration vector of the car 1 is the descent direction, and the direction of the acceleration vector of the counterweight 2 is the ascent direction.

(C) During acceleration in the case where the car 1 descends, the direction of the acceleration vector of the car 1 is the descent direction, and the direction of the acceleration vector of the counterweight 2 is the ascent direction.

(D) During deceleration in the case where the car 1 descends, the direction of the acceleration vector of the car 1 is the ascent direction, and the direction of the acceleration vector of the counterweight 2 is the descent direction.

From the foregoing, in the case where the load weight of the car 1 is more than 50% of the maximum load weight in (1), the direction of the acceleration vector of one of the car 1 side and the counterweight 2 side that is heavier than the other, i.e., the car 1 is the ascent direction in the cases of (A) and (D). That is, in the case where the car 1 has the load weight and the acceleration of the car 1 of which "load weight is more than 50% of the maximum load weight" and that "accelerates when the car 1 ascends or decelerates when the car 1 descends", the determination execution condition is satisfied.

In addition, in the case where the load weight of the car 1 is less than 50% of the maximum load weight in (2), the direction of the acceleration vector of one of the car 1 side and the counterweight 2 side that is heavier than the other, i.e., the counterweight 2 is the ascent direction in the cases of (B) and (C). That is, also in the case where the car 1 has the load weight and the acceleration of the car 1 of which "load weight is less than 50% of the maximum load weight" and that "decelerates when the car 1 ascends or accelerates when the car 1 descends", the determination execution condition is satisfied.

First, the section specification unit 31 locates the travel position of the car 1 that satisfies the above-described determination execution condition in the present travel of the car 1 based on the load weight of the car 1 detected by the weighing device 13 and travel information (especially a departure floor and a destination floor) of the car 1 acquired from the elevator control unit 21. Subsequently, the section specification unit 31 locates the travel section of the car 1 including the travel position of the car 1 that satisfies the determination execution condition, and specifies that the travel section is the determination target section.

Note that the section specification unit 31 specifies the determination target section such that each of the starting point and the end point of the determination target section is positioned in the door zone. With this, the car position detector 12 can detect the passage of the car 1 through the starting point and the end point of the determination target section.

It is only required that the determination target section includes the travel position of the car 1 that satisfies the determination execution condition, and it is not necessary to satisfy the determination execution condition in the entire determination target section. That is, it is only required that the determination execution condition is satisfied in at least part of the determination target section. At this point, it is possible to shorten the determination target section by having the determination target section corresponding to one floor, i.e., by setting the starting point in the door zone of a given floor and setting the end point in the door zone of a floor next to the given floor.

Further, as the determination execution condition, a condition of the load weight of the car 1 that increases a difference between the weight of the side of the car 1 and the weight of the side of the counterweight 2 may be set. Specifically, for example, a condition that the load weight of the car 1 is less than 10% of the maximum load weight or more than 90% thereof maybe additionally set as the determination execution condition.

The previous data storage unit 32 stores the rotation amount of the sheave 4 detected by the sheave rotation detector 11 during the travel of the car 1 in the determination target section previously determined by the section specification unit 31. Specifically, for example, the previous data storage unit 32 stores the date and time of the travel of the car 1, the floor serving as the starting point of the determination target section and the floor serving as the end point of the determination target section (i.e., the travel section and the travel direction of the car 1), and the rotation amount of the sheave 4 detected by the sheave rotation detector 11.

The determination unit 33 determines the traction performance of the sheave 4 based on the rotation amount of the sheave 4 detected by the sheave rotation detector 11 during the travel of the car 1 in the determination target section determined by the section specification unit 31. The determination unit 33 performs the determination by using, e.g., a predetermined reference value. The reference value storage unit 34 pre-stores the reference value used in the determination of the traction performance of the sheave 4 by the determination unit 33. A reference value setting method and a determination method of the traction performance of the sheave 4 that uses the reference value in this determination conceivably include a plurality of methods. Hereinafter, a description will be given of a plurality of examples of the reference value setting method and the determination method of the traction performance of the sheave 4 that uses the reference value sequentially.

In the first example described first, the reference value storage unit 34 pre-stores the reference value predetermined for each distance of the determination target section. The determination unit 33 determines the traction performance of the sheave 4 by comparing the rotation amount of the sheave 4 detected by the sheave rotation detector 11 during the travel of the car in the determination target section with the reference value corresponding to the distance of the determination target section stored in the reference value storage unit 34. Subsequently, for example, in the case where the rotation amount of the sheave 4 is not less than the reference value, the determination unit 33 determines that the traction performance of the sheave 4 is reduced.

Note that, as described above, in the case where the starting point and the end point of the determination target section are set in the door zones, the distance of the determination target section is a movement distance of the car 1 from the door zone to the door zone between two floors. Accordingly, the distance of the determination target section may be automatically set by learning the movement distance when the car 1 is caused to travel at a speed lower than usual from the door zone to the door zone between two floors in advance. In this manner, by periodically learning and updating the movement distance of the car 1 from the door zone to the door zone between two floors, it is possible to correct the change of the rotation amount of the sheave 4 over time, caused by a reduction in the diameter of the main rope 3 and wear of the sheave 4.

Next, in the second example, the reference value storage unit 34 pre-stores the reference value predetermined for each determination target section. The determination unit 33 determines the traction performance of the sheave 4 by comparing the rotation amount of the sheave 4 detected by the sheave rotation detector 11 during the travel of the car in the determination target section with the reference value corresponding to the determination target section stored in the reference value storage unit 34. Subsequently, for example, in the case where the rotation amount of the sheave 4 is not less than the reference value, the determination unit 33 determines that the traction performance of the sheave 4 is reduced.

In addition, in the third example, the reference value storage unit 34 pre-stores the reference value predetermined for each combination of the determination target section and the travel direction of the car 1. The determination unit 33 determines the traction performance of the sheave by comparing the rotation amount of the sheave detected by the sheave rotation detector 11 during the travel of the car in the determination target section with the reference value set for the combination of the determination target section and the travel direction of the car that is stored in the reference value storage unit 34. Subsequently, for example, in the case where the rotation amount of the sheave 4 is not less than the reference value, the determination unit 33 determines that the traction performance of the sheave 4 is reduced.

Note that, in each of the first to third examples, with regard to the rotation amount of the sheave 4, the determination unit 33 may acquire and use the rotation amount thereof stored in the previous data storage unit 32, and may also use the rotation amount thereof acquired from the sheave rotation detector 11.

In addition, in each of the first to third examples, in the case where a difference between the rotation amount of the sheave 4 and the reference value is not less than a present allowable value, the determination unit 33 may determine that the traction performance of the sheave 4 is reduced.

The allowable value used at this point may be determined based on the amount of slippage (amount of creep) caused by expansion and contraction of the main rope 3 when the main rope 3 passes through the sheave 4. The amount of slippage (amount of creep) C caused by the expansion and contraction of the main rope 3 when the main rope 3 passes through the sheave 4 can be calculated by the following expression based on a coefficient N determined by the roping method of the main rope 3, the stiffness (elastic coefficient K) of the main rope 3, the tension T1 of the main rope 3 on the side of the car 1, and the tension T2 of the main rope 3 on the side of the counterweight 2.

$$C=(T1-T2)/(N\cdot K) \text{ where } T1>T2 \text{ is satisfied}$$

By setting the allowable value used in the determination in the determination unit 33 to a value of not less than the amount of slippage (amount of creep) C caused by the expansion and contraction of the main rope 3 when the main rope 3 passes through the sheave 4, it is possible to perform the determination of the traction performance of the sheave 4 in consideration of the change of the rotation amount of the sheave 4 by the creep. That is, in the case where the traction performance of the sheave 4 is not reduced and only the change of the rotation amount of the sheave 4 by the creep occurs, it is possible to prevent an erroneous determination that the traction performance of the sheave 4 is reduced.

In addition, at this point, by using, among possible values of the elastic coefficient K, the minimum value in consideration of the change of the stiffness (elastic coefficient K) of the main rope 3 over time, it is possible to perform the determination of the traction performance of the sheave 4 in which the maximum value of the amount of creep C is reflected, and further prevent the erroneous determination of the traction performance of the sheave 4.

Further, as can be seen from the expression of the amount of creep C described above, the higher the tension T1 of the main rope 3 on the side of the car 1 is, i.e., the heavier the load weight of the car 1 is, the larger the amount of creep C is. Consequently, the allowable value used in the determination in the determination unit 33 may be set to be not less than the maximum value of the amount of slippage caused by the expansion and contraction of the main rope 3 when the main rope 3 passes through the sheave 4 in the case where the load weight of the car 1 is changed.

Herein, the maximum value of the amount of slippage caused by the expansion and contraction of the main rope 3 when the main rope 3 passes through the sheave 4 in the case where the load weight of the car 1 is changed corresponds to the amount of creep when the load weight of the car 1 is the maximum load weight. Consequently, in other words, the allowable value used in the determination in the determination unit 33 may be set to be not less than the amount of creep when the load weight of the car 1 is the maximum load weight. With this, it is possible to perform the determination of the traction performance of the sheave 4 in which the maximum value of the amount of creep C is reflected, and further prevent the erroneous determination of the traction performance of the sheave 4. Specifically, for example, the amount of creep is usually about 0.05% to 0.15% relative to the feed amount of the main rope 3, and hence it is conceivable to set the allowable value to a value corresponding to about 0.2% of the feed amount or the main rope 3.

Note that the slippage (creep) caused by the expansion and contraction of rope 3 when the main rope 3 passes through the sheave 4 occurs only on the side to which the main rope 3 is fed from the sheave 4. That is, the movement amount of the car 1 relative to the rotation amount of the sheave 4 is influenced by the creep in the case where the car 1 travels in the descent direction, and hence it is not necessary to consider the influence of the creep when the car 1 travels in the ascent direction.

The reference value correction unit 35 corrects the reference value stored in the reference value storage unit 34 in accordance with the change of the rotation amount of the sheave over time, caused by the reduction in the diameter of the main rope 3 and the wear of the sheave 4. The determination unit 33 performs the determination of the traction performance of the sheave 4 by using the reference value corrected by the reference value correction unit 35.

Note that, in the case of the first example of the reference value setting method described above, the reference value correction unit 35 may correct the movement distance of the car 1 from the door zone to the door zone between two floors instead of directly correcting the reference value. In the case where the change of the rotation amount of the sheave 4 over time is caused by the reduction in the diameter of the main rope 3 and the wear of the sheave 4, when the rotation amount of the sheave 4 is used as the basis, the movement distance of the car 1 changes even when the rotation amount of the sheave 4 is unchanged. Accordingly, by correcting the apparent movement distance of the car 1 from the door zone to the door zone between two floors that is based on the rotation amount of the sheave 4, it is possible to obtain the same effect as that in the case where the reference value is directly corrected.

In addition, as described above, in the case where the movement distance of the car 1 from the door zone to the door zone between two floors is periodically learned and updated, the change of the rotation amount of the sheave 4 over time, caused by the reduction in the diameter of the main rope 3 and the wear of the sheave 4 is automatically taken into consideration. Consequently, in this case, it is not necessary to provide the reference value correction unit 35.

In the case where the determination unit 33 determines that the traction performance of the sheave 4 is reduced, a notification unit 36 notifies a management office in a building where the elevator apparatus is installed or the outside information center 23 of the reduction in the traction performance of the sheave 4. With this, in the case where the traction performance of the sheave 4 is reduced, it is possible to provide notification of necessity for maintenance to properly cope with the reduction in the traction performance thereof.

In addition, in the case where the determination unit 33 of the traction diagnosis unit 30 determines that the traction performance of the sheave 4 is reduced, the elevator control unit 21 may stop the operation of the car 1.

Next, a description will be given of an example of the operation of the thus configured elevator apparatus with reference to FIG. 4. When the travel of the car 1 is started, first, the section specification unit 31 of the traction diagnosis unit 30 checks whether or not the travel section of the travel of the car 1 includes acceleration or deceleration in Step S1. In the case where the travel section does not include acceleration or deceleration, a flow including a series of actions is ended. On the other hand, in the case where the travel section of the car 1 includes acceleration or deceleration in Step 1, the flow proceeds to Step S2.

In Step S2, the section specification unit 31 checks whether or not the load weight of the car 1 has an imbalance between the weight on the side of the car 1 and the weight on the side of the counterweight 2 based on the detection result of the weighing device 13. In the case where the load weight of the car 1 does not have the imbalance between the weight on the side of the car 1 and the weight on the side of the counterweight 2, the flow including a series of actions is ended. On the other hand, in the case where the load weight of the car 1 has the imbalance between the weight on the side of the car 1 and the weight on the side of the counterweight 2 in Step S2, the flow proceeds to Step S3.

In Step S3, the section specification unit 31 checks whether or not the direction of acceleration or deceleration of the car 1 is a direction that increases the ratio between the tension applied to the main rope 3 on the side of the car 1 and the tension applied to the main rope 3 on the side of the counterweight 2. That is, this is an operation for checking whether or not the direction of the acceleration vector of one of the car 1 side and the counterweight 2 side that is heavier than the other is the ascent direction.

In the case where the direction of the acceleration vector of one of the car 1 side and the counterweight 2 side that is heavier than the other is not the ascent direction, the flow including a series of actions is ended. On the other hand, in the case where the direction of the acceleration vector of the car 1 side and the counterweight 2 side that is heavier than the other is the ascent direction in Step S3, the section specification unit 31 specifies that the travel section of the travel of the car 1 is the determination target section, and the flow proceeds to Step S4.

In Step S4, the traction diagnosis unit 30 checks whether or not the car 1 has completed the travel between floors, i.e., the travel in the determination target section specified by the section specification unit 31 in Step S3. Subsequently, the flow waits until the car 1 completes the travel in the determination target section and, when the car 1 completes the travel in the determination target section, the flow proceeds to Step S5.

In Step S5, information on the rotation amount of the sheave 4 detected by the sheave rotation detector 11 during the travel of the car 1 between floors, i.e., in the determination target section is stored in the previous data storage unit 32 of the traction diagnosis unit 30.

In subsequent Step S6, the determination unit 33 of the traction diagnosis unit 30 determines whether or not the traction performance of the sheave 4 is reduced by comparing the rotation amount of the sheave 4 stored in Step S5 with the reference value stored in the reference value storage unit 34. At this point, as described above, the use of the allowable value predetermined based mainly on the creep may be considered. In addition, the reference value corrected by the reference value correction unit 35 or the allowable value may also be used on an as needed basis.

In the case where it is determined that the traction performance of the sheave 4 is not reduced, the flow including a series of actions is ended. On the other hand, in the case where it is determined that the traction performance of the sheave 4 is reduced in Step S6, the flow proceeds to Step S7.

In Step S7, the notification unit 36 notifies the information center 23 or the like of the detection of the reduction in the traction performance of the sheave 4 by the traction diagnosis unit 30. In subsequent Step S8, the elevator control unit 21 stops the operation of the car 1 for which the reduction in the traction performance of the sheave 4 is detected by the traction diagnosis unit 30. Subsequently, when Step 8 is completed, the flow including a series of actions is ended.

Note that FIG. 1 shows the case where the roping method is 1:1 roping. However, the roping method is not limited to 1:1 roping. That is, the roping method may also be another roping method such as 2:1 roping or the like as long as the elevator apparatus according to the invention is the traction type elevator apparatus.

In addition, in the foregoing description, the description has been made by assuming the case where the traction diagnosis unit 30 is provided in the building in which the elevator apparatus is installed, particular in a control panel of the elevator apparatus. However, the installation place of the traction diagnosis unit 30 is not limited thereto, and the traction diagnosis unit 30 may also be provided in, e.g., the information center 23.

In the thus configured elevator apparatus, the determination target section including the travel position of the car 1 that satisfies the determination execution condition that increases the amount of slippage of the main rope 3 relative to the sheave 4 is determined, and the traction performance of the sheave 4 is checked based on the rotation amount of the sheave 4 in the determination target section. That is, the traction performance of the sheave 4 is checked intentionally based on the rotation amount of the sheave 4 under the travel condition that allows the amount of slippage of the main rope 3 relative to the sheave 4 to easily increase. Consequently, it is possible to increase the amount of slippage of the main rope 3 relative to the sheave 4 in the initial stage in which the reduction in the traction performance of the sheave 4 is started, and detect the reduction in the traction performance immediately even in the initial stage of the reduction in the traction performance.

In addition, it is possible to execute the traction performance diagnosis by performing one-way travel once without causing the car 1 to go and come back. Further, it is also possible to execute the traction performance diagnosis by travel when service is provided by the car 1 of the elevator serving as the diagnosis target. Consequently, it is not necessary to stop the provision of the service in order to perform the traction performance diagnosis.

Embodiment 2.

Figure 5:
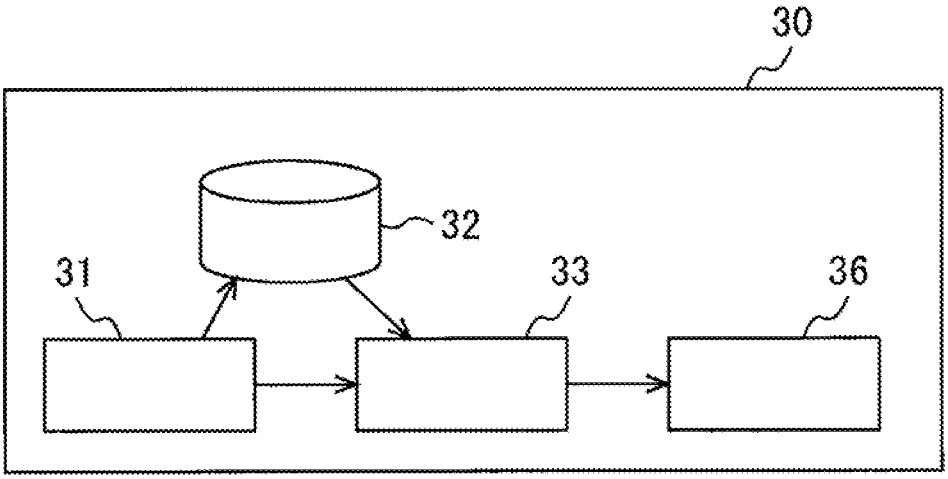
FIG. 5 is a block diagram showing the configuration of the traction diagnosis unit provided in the elevator apparatus related to Embodiment 2 of the present invention.
Figure 7:
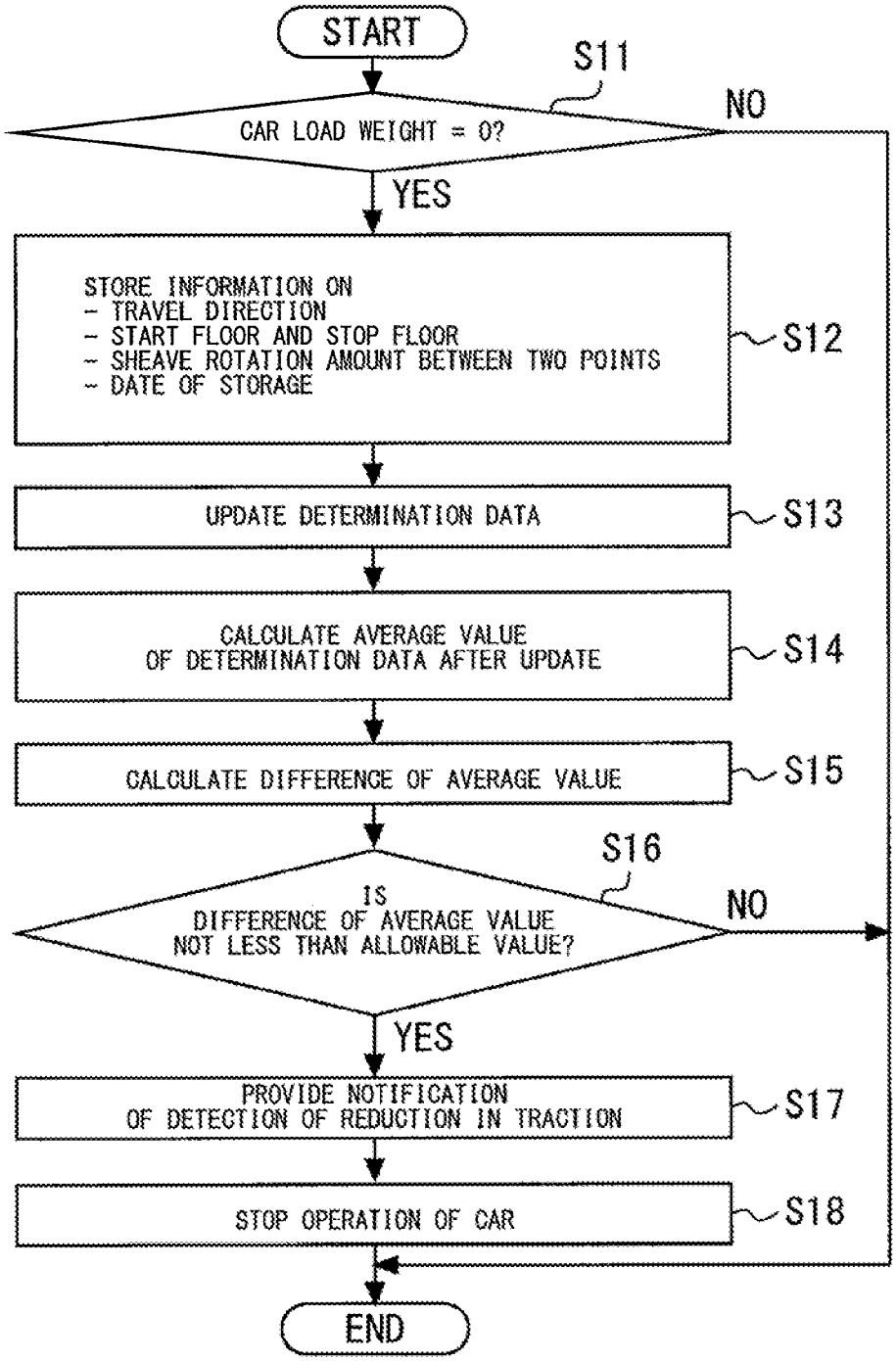
FIG. 7 is a flowchart showing an example of the operation of the elevator apparatus related to Embodiment 2 of the present invention.

FIGS. 5 to 7 relate to Embodiment 2 of the invention. FIG. 5 is a block diagram showing the configuration of the traction diagnosis section provided in the elevator apparatus, FIG. 6 is a view for explaining an example of a traction diagnosis method of the sheave of the elevator apparatus, and FIG. 7 is a flowchart showing an example of the operation of the elevator apparatus.

In Embodiment 1 described above, the traction performance diagnosis of the sheave is performed by comparing the detected rotation amount of the sheave with the predetermined reference value. In contrast to this, in Embodiment 2 described below, the traction performance diagnosis of the sheave is performed by comparing the rotation amount of the sheave that is presently detected with the rotation amount of the sheave that was previously detected.

Hereinafter, the elevator apparatus according to Embodiment 2 will be described with a focus on points different from Embodiment 1. As shown in FIG. 5, in Embodiment 2, the traction diagnosis unit 30 includes the section specification unit 31, the previous data storage unit 32, the determination unit 33, and the notification unit 36. Among them, the section specification unit 31 and the notification unit 36 are the same as those in Embodiment 1, and hence the description thereof will be omitted.

In the previous data storage unit 32, the travel section of the car 1, the travel direction thereof, and the rotation amount of the sheave 4 detected by the sheave rotation detector 11 are stored for each travel of the car 1. The determination unit 33 determines the traction performance of the sheave 4 by comparing the rotation amount of the sheave 4 detected by the sheave rotation detector 11 during the travel of the car 1 in the determination target section with the rotation amount of the sheave 4 stored in the previous data storage unit 32. At this point, with regard to the rotation amount of the sheave 4 stored in the previous data storage unit 32 that is used in the comparison, for example, the following two types of methods are conceivable.

First, the first method is a method that uses, in the comparison, the rotation amount of the sheave 4 detected by the sheave rotation detector 11 during the previous travel of the car 1 in the travel section identical to that in present travel and in the travel direction identical to that in the present travel. In this method, first, the determination unit 33 acquires the rotation amount of the sheave 4 detected by the sheave rotation detector 11 during the previous travel of the car 1 in the travel section identical to that in the present travel and in the travel direction identical to that in the present travel from the previous data storage unit 32. Subsequently, the determination unit 33 compares the rotation amount of the sheave 4 detected by the sheave rotation detector 11 during the present travel with the rotation amount of the sheave 4 acquired from the previous data storage unit 32.

In this comparison, for example, in the case where a difference between the rotation amount of the sheave 4 in the present travel and the rotation amount of the sheave 4 acquired from the previous data storage unit 32 is not less than a predetermined allowable value, the determination unit 33 determines that the traction performance of the sheave 4 is reduced. Note that, in the case where there are a plurality of pieces of previous data that are associated with the travel section identical to that in the present travel and the travel direction opposite to that in the present travel, the average value of the rotation amounts of the sheave 4 in the plurality of pieces of previous data may be used as the comparison target and, among the plurality of pieces of previous data, the rotation amount of the sheave 4 in the latest piece of previous data may also be used as the comparison target.

Next, the second method is a method that uses, in the comparison, the rotation amount of the sheave 4 detected by the sheave rotation detector 11 during the previous travel of the car 1 in the travel section identical to that in the present travel and in the travel direction opposite to that in the present travel. In this method, first, the determination unit 33 acquires the rotation amount of the sheave 4 detected by the sheave rotation detector 11 during the previous travel of the car 1 in the travel section identical to that in the present travel and in the travel direction opposite to that in the present travel from the previous data storage unit 32.

Subsequently, the determination unit 33 compares the rotation amount of the sheave 4 detected by the sheave rotation detector 11 during the present travel with the rotation amount of the sheave 4 acquired from the previous data storage unit 32. In this comparison, for example, in the case where a difference between the rotation amount of the sheave 4 in the present travel and the rotation amount of the sheave 4 acquired from the previous data storage unit 32 is not less than a predetermined allowable value, the determination unit 33 determines that the traction performance of the sheave 4 is reduced.

Note that, in the case where there are a plurality of pieces of previous data that are associated with the travel section identical to that in the present travel and the travel direction opposite to that in the present travel, the average value of the rotation amounts of the sheave 4 in the plurality of pieces of previous data may be used as the comparison target and, among the plurality of pieces of previous data, the rotation amount of the sheave 4 in the latest piece of previous data may also be used as the comparison target.

In the case where the average value of the rotation amounts of the sheave 4 in the plurality of pieces of previous data that are associated with the travel section identical to that in the present travel and the travel direction opposite to that in the present travel is used as the comparison target, the comparison may be performed by using the average value of the rotation amount of the sheave 4 when the travel section is identical to that in the present travel and the travel direction is identical to that in the present travel instead of performing the comparison by using the rotation amount of the sheave 4 in the present travel without altering it. That is, the average value of the rotation amount of the sheave 4 in the previous data that is associated with the travel section identical to that in the present travel and the travel direction identical to that in the present travel and the rotation amount of the sheave 4 in the present travel may be compared with the average value of the rotation amounts of the sheave 4 in the plurality of pieces of previous data that are associated with the travel section identical to that in the present travel and the travel direction opposite to that in the present travel.

The traction diagnosis method of the sheave 4 in this case will be further described with reference to FIG. 6. "start DN direction" described in the section of "operation" in FIG. 6 denotes the case of travel in the descent direction from the corresponding floor serving as the departure floor to the first floor, "stop UP direction" denotes the case of travel in the ascent direction from the first floor to the corresponding floor serving as a stop floor. In addition, "pulse" in the section of "type" denotes the number of pulses outputted from the sheave rotation detector 11 and, i.e., corresponds to the rotation amount of the sheave 4 detected by the sheave rotation detector 11. "date" in the section of "type" is a date when the rotation amount of the sheave 4 is detected.

In the case where a condition predetermined for the load weight of the car 1 is satisfied during the travel of the car 1, e.g., in the case where the load weight is 0 (the car 1 is empty), the traction diagnosis unit 30 causes the previous data storage unit 32 to store the rotation amount of the sheave 4 detected by the sheave rotation detector 11 first. At this point, for example, as shown in FIG. 6, the rotation amount of the sheave 4 is classified according to the start floor (departure floor) of the car 1, the stop floor (destination floor) thereof, and the travel direction thereof, and is stored in the previous data storage unit 32 together with the date of the detection.

Note that, by using data particularly in the case where the car 1 is empty in the traction performance diagnosis, it is possible to easily increase the amount of slippage of the main rope 3 relative to the sheave 4 by, e.g., causing the car 1 to travel with a high acceleration without paying attention to ride comfort because there is no user in in the car 1.

When the data on the rotation amount of the sheave 4 stored in the previous data storage unit 32 is updated, the determination unit 33 calculates the average value of the rotation amount of the sheave 4 during ascent travel and the average value of the rotation amount of the sheave 4 during descent travel for each travel section. Next, the determination unit 33 calculates a difference between the average value of the rotation amount of the sheave 4 during the ascent travel and the average value of the rotation amount of the sheave 4 during the descent travel. Subsequently, the determination unit 33 determines whether or not the difference between the average value of the rotation amount of the sheave 4 during the ascent travel and the average value of the rotation amount of the sheave 4 during the descent travel is not less than a predetermined allowable value. In the case where the difference between the average value of the rotation amount of the sheave 4 during the ascent travel and the average value of the rotation amount of the sheave 4 during the descent travel is not less than the allowable value, the determination unit 33 determines that the traction performance of the sheave 4 is reduced.

Note that, in the case where blank data such as data in "previous 2" of "start DN direction" of "3F" is present due to some cause, the blank data is excluded from the calculation target of the average value. In addition, old data that has been maintained for a predetermined time period or longer is excluded from the calculation target of the average value. The old data that has been maintained for a predetermined time period or longer such as data in each of "previous 1" and "previous 2" of "stop UP direction" of "4F" is also excluded from the calculation target of the average value.

Next, a description will be given of an example of the operation of the traction diagnosis unit 30 in the case where the traction performance diagnosis of the sheave 4 is performed based on the difference between the average value of the rotation amount of the sheave 4 during the ascent travel and the average value of the rotation amount of the sheave 4 during the descent travel in the same section with reference to the flowchart in FIG. 7. When the travel of the car 1 is started, first, in Step S11, the traction diagnosis unit 30 checks whether or not the load weight of the car 1 is 0 based on the detection result of the weighing device 13. In the case where the load weight of the car 1 is not 0, a flow including a series of actions is ended.

On the other hand, in the case where the load weight of the car 1 is 0 in Step S11, the flow proceeds to Step S12. In Step S12, the previous data storage unit 32 stores the travel direction of the car 1, the start floor and the step floor thereof, the rotation amount of the sheave 4 detected by the sheave rotation detector 11 during the travel between two points, i.e., from the start floor to the stop floor, and the date when the information is stored.

In subsequent Step S13, the determination unit 33 updates data (determination data) used in the traction performance determination of the sheave 4 based on the information stored in the previous data storage unit 32. The format of the determination data is, e.g., the format shown in FIG. 6. Subsequently, the flow proceeds to Step S14, and the determination unit 33 calculates the average value of the rotation amount of the sheave 4 during the ascent travel and the average value of the rotation amount of the sheave 4 during the descent travel for each travel section based on the determination data updated in Step S13.

After Step S14, the flow proceeds to Step S15. In Step S15, the determination unit 33 calculates the difference between the average value of the rotation amount of the sheave 4 during the ascent travel and the average value of the rotation amount of the sheave 4 during the descent travel by using the average values calculated in Step S14. In subsequent Step S16, the determination unit 33 determines whether or not the difference of the average value calculated in Step S15 is not less than the predetermined allowable value. In the case where the difference of the average value is less than the predetermined allowable value, the flow including a series of actions is ended. On the other hand, in the case where the difference of the average value is not less than the predetermined allowable value, the flow proceeds to Step S17.

In Step S17, the notification unit 36 notifies the information center 23 or the like of the detection of the reduction in the traction performance of the sheave 4 by the traction diagnosis unit 30. In subsequent Step S18, the elevator control unit 21 stops the operation of the car 1 for which the reduction in the traction performance of the sheave 4 is detected by the traction diagnosis unit 30. Subsequently, when Step S18 is completed, the flow including a series of actions is ended.

Note that the other configurations and operations are the same as those in Embodiment 1, and the detailed description thereof will be omitted.

In the thus configured elevator apparatus, similarly to Embodiment 1, by checking the traction performance of the sheave 4 intentionally based on the rotation amount of the sheave 4 under the travel condition that allows the amount of slippage of the main rope 3 relative to the sheave 4 to easily increase, even in the initial stage of the reduction in the traction performance, it is possible to detect the reduction in the traction performance immediately.

In addition, in the determination of the traction performance, the previously stored data on the rotation amount of the sheave 4 is used instead of comparing the rotation amount of the sheave 4 with the reference value, and hence it is not necessary to set the reference value. Further, since it is not necessary to set the reference value, it is not necessary to correct the reference value in consideration of the change of the rotation amount of the sheave 4 over time, caused by the reduction in the diameter of the main rope 3 and the wear of the sheave 4, and it is possible to make the influence of the change of the rotation amount of the sheave 4 over time less likely to be exerted.

INDUSTRIAL APPLICABILITY

The invention can be used in the traction type elevator apparatus in which the middle portion of the main rope from which the car and the counterweight are suspended is wound around the sheave of the traction machine.

REFERENCE SIGNS LIST

1 Car
2 Counterweight
3 Main rope
4 Sheave
5 Traction machine
6 Brake
7 Governor
8 Governor rope
9 Hall
11 Sheave rotation detector
12 Car position detector
12*a* Plate detection device
12*b* Detection plate
13 Weighing device
21 Elevator control unit
23 Information center
30 Traction diagnosis unit
31 section specification unit
32 Previous data storage unit
33 Determination unit
34 Reference value storage unit
35 Reference value correction unit
36 Notification unit

The invention claimed is:

1. An elevator apparatus comprising:

a traction machine having a sheave around which a middle portion of a main rope is wound, the main rope having one end from which a car is suspended and the other end from which a counterweight is suspended;

a control unit configured to cause the car to travel by controlling an operation of the traction machine;

a section specification unit configured to specify a determination target section which is a travel section including at least a travel position of the car at which a predetermined determination execution condition which is to have a load weight and an acceleration of the car that cause a direction of an acceleration vector of one of a car side and a counterweight side that is heavier than the other to match an ascent direction occurs is satisfied;

a sheave rotation detector configured to detect a rotation amount of the sheave;

a determination unit configured to determine traction performance of the sheave, based on the rotation amount of the sheave detected by the sheave rotation detector during travel of the car in the determination target section.

2. The elevator apparatus according to claim 1, further comprising:

a reference value storage unit configured to pre-store a reference value predetermined for each distance of the determination target section, wherein the determination unit is configured to determine the traction performance of the sheave by comparing the rotation amount of the sheave detected by the sheave rotation detector during the travel of the car in the determination target section with the reference value corresponding to the distance of the determination target section stored in the reference value storage unit.

3. The elevator apparatus according to claim 1, further comprising:

a reference value storage unit configured to pre-store a reference value predetermined for each determination target section, wherein the determination unit is configured to determine the traction performance of the sheave by comparing the rotation amount of the sheave detected by the sheave rotation detector during the travel of the car in the determination target section with the reference value corresponding to the determination target section stored in the reference value storage unit.

4. The elevator apparatus according to claim 1, further comprising:

a reference value storage unit configured to pre-store a reference value predetermined for each combination of the determination target section and a travel direction of the car, wherein the determination unit is configured to determine the traction performance of the sheave by comparing the rotation amount of the sheave detected by the sheave rotation detector during the travel of the car in the determination target section with the reference value set for the combination of the determination target section and the travel direction of the car stored in the reference value storage unit.

5. The elevator apparatus according to claim 1, further comprising:

a previous data storage unit configured to store the travel section of the car, a travel direction of the car, and the rotation amount of the sheave detected by the sheave rotation detector for each travel of the car, wherein the determination unit is configured to determine the traction performance of the sheave by comparing the rotation amount of the sheave detected by the sheave rotation detector during the travel of the car in the determination target section with the rotation amount of the sheave that is stored in the previous data storage unit, and is associated with the travel section identical to a travel section in present travel and the travel direction identical to a travel direction in the present travel.

6. The elevator apparatus according to claim 1, further comprising:

a previous data storage unit configured to store the travel section of the car, a travel direction of the car, and the rotation amount of the sheave detected by the sheave rotation detector for each travel of the car, wherein the determination unit is configured to determine the traction performance of the sheave by comparing the rotation amount of the sheave detected by the sheave rotation detector during the travel of the car in the determination target section with the rotation amount of the sheave that is stored in the previous data storage unit, and is associated with the travel section identical to a travel section in present travel and the travel direction opposite to a travel direction in the present travel.

7. The elevator apparatus according to claim 2, further comprising:

a correction unit configured to correct the reference value stored in the reference value storage unit in accordance with change of the rotation amount of the sheave caused by a reduction in diameter of the main rope and wear of the sheave.

8. The elevator apparatus according to claim 2, wherein the determination unit is configured to determine that the traction performance of the sheave is reduced in a case where a difference between the rotation amount of the sheave detected by the sheave rotation detector during the travel of the car in the determination target section and the reference value is not less than a predetermined allowable value.

9. The elevator apparatus according to claim 8, wherein the allowable value is determined based on an amount of slippage caused by expansion and contraction of the main rope when the main rope passes through the sheave.

10. The elevator apparatus according to claim 9, wherein the amount of slippage caused by expansion and contraction of the main rope when the main rope passes through the sheave is calculated based on a roping method of the main rope, stiffness of the main rope, tension of the main rope on the car side, and tension of the main rope on the counterweight side.

11. The elevator apparatus according to claim 10, wherein the mount of slippage caused by expansion and contraction of the main rope when the main rope passes through the sheave is calculated in consideration of change of the stiffness of the main rope over time.

12. The elevator apparatus according to claim 8, wherein the allowable value is set to be not less than a maximum value of the amount of slippage caused by expansion and contraction of the main rope when the main rope passes through the sheave in a case where the load weight of the car is changed.

* * * * *